US005361526A

United States Patent [19]

Campbell

[11] Patent Number: 5,361,526

[45] Date of Patent: Nov. 8, 1994

[54] QUICK RELEASE CHILD RESISTANT SAFETY AND SECURITY DEVICE

[76] Inventor: William J. Campbell, P.O. Box 313, Lolo, Mont. 59847-0313

[21] Appl. No.: 207,225

[22] Filed: Mar. 4, 1994

Related U.S. Application Data

[63] Continuation of Ser. No. 992,603, Dec. 18, 1992, abandoned.

[51] Int. Cl.[5] ..... F41A 17/34; F41A 17/44

[52] U.S. Cl. ..... 42/70.11; 42/70.02; 89/1.25

[58] Field of Search ..... 42/70.11, 70.01, 70.02, 42/70.07; 89/1.25

[56] References Cited

U.S. PATENT DOCUMENTS

| | | | |
|---|---|---|---|
| 2,997,802 | 8/1961 | Robbins | 42/70.01 |
| 3,990,169 | 11/1976 | Jennie et al. | 42/70.01 |
| 4,058,923 | 11/1977 | Smith | 42/70.11 |
| 4,224,753 | 9/1980 | Bielman | 42/70.11 |
| 4,384,420 | 5/1983 | Von Muller | 42/1 LP |
| 4,412,397 | 11/1983 | Bayn | 42/1 LP |
| 4,528,765 | 7/1985 | Johnson | 42/1 LP |
| 4,644,676 | 2/1987 | Stern | 42/70.07 |
| 4,654,992 | 4/1987 | Lavergne | 42/70.01 |
| 4,908,971 | 3/1990 | Chaney | 42/70.11 |
| 4,961,277 | 10/1990 | Rosenbaum | 42/70.11 |
| 4,969,284 | 11/1990 | Healey et al. | 42/70.11 |
| 5,099,596 | 3/1992 | Butler, Jr. | 42/70.11 |
| 5,241,769 | 9/1993 | Von Muller | 42/70.11 |

FOREIGN PATENT DOCUMENTS

| | | | |
|---|---|---|---|
| 2920679 | 11/1979 | Germany | 42/70.11 |

*Primary Examiner*—Stephen M. Johnson
*Attorney, Agent, or Firm*—John R. Flanagan

[57] ABSTRACT

A child resistant quick release firearm safety and security device wherein the one piece device is inserted into the loading port of a tubular magazine, bottom loading, firearm. The operative position places the safety and security device under pressure from the magazine spring and the firearm is disabled by blocking internal mechanisms. The firearm cannot be loaded either externally through the ejection port or internally from the magazine. Further, the outer surface of the safety and security device substantially fills the loading port to act as both a dust and anti-tamporing cover. The body is shared so as to retain anti-corrosion, agents within the firearm. Removal is by catching the fingernails in a recess on the outer surface of the body and pulling the safety and security device forward toward the magazine tube. Upon being moved forward as far as possible the safety and security device will flip free of the firearm, thereby enabling immediate operation of the firearm.

16 Claims, 2 Drawing Sheets

QUICK RELEASE CHILD RESISTANT SAFETY AND SECURITY DEVICE

This application is a continuation of application Ser. No. 07/992,603, filed Dec. 18, 1992 now abandoned.

FIELD OF INVENTION

Subject invention relates generally to safety and security devices for firearms and specifically to those portable devices applicable to firearms utilizing a bottom loaded tubular magazine.

DISCUSSION OF PRIOR ART

Many firearms are kept within homes and vehicles for personal protection. The firearm is commonly in a state of readiness allowing accidental discharge, tampering or unauthorized use.

Prior attempts to provide increased firearm safety are numerous and reflect many methods including plugging the chamber or barrel, blocking the hammer, trigger, bolt or other part of the operating mechanisms. Such deactivation has included the use of cables, rods, chains, locks and straps. These included the requirement for firearm modification, keys, combinations or tools to remove the devices. Other devices use elastic materials subject to deterioration as shown in U.S. Pat. No. 5,099,596 issued to B. Butler Jr. on Mar. 31, 1992. U.S. Pat. No. 4,961,277 issued to N. Rosenbaum on Oct. 9, 1990 uses a strap of fixed length with a removable muzzle cap. A form of strap used in U.S. Pat. No. 4,412,397 issued to W. Bayn on Nov. 1, 1983 required the strap be broken for removal. U.S. Pat. No. 4,644,676 issued to M. Stern on Feb. 24, 1987 used a device that completely wrapped around a handgun. The barrel and chamber are plugged in U.S. Pat. No. 4,908,971 issued to J. Chaney on Mar. 20, 1990 and U.S. Pat. No. 4,969,284 issued to C. Healey on Nov. 13, 1990. Yet another approach is to block the bolt as shown in U.S. Pat. No. 4,384,420 issued to F. Von Muller on May 24, 1983 used a magazine inserted device which prevented loading and blocked the firing mechanism.

While handguns have received considerable attention regarding quick release safety devices, other types of firearms have not. Accordingly, there is a need for a safety and security device that will minimize the risk present in having a firearm, other than a handgun, in a state of readiness adequate for defensive purposes. Such a device should minimize the possibility of discharge or tampering by children yet be instantly removable. Increasing the need for hand/eye coordination and strength requirements can raise the removal requirements to a level generally unattainable by children but easily exceeded by an adult.

SUMMARY OF INVENTION

Subject invention is a small, light, unobtrusive, inexpensive, one piece device using internal firearm mechanisms for pre-load force adequate to retain the safety and security device in place to prevent or disrupt the operating cycle. Placement and removal of the safety and security device are instant, noiseless, require no tools or aides and can be accomplished by feel. The simplicity provides a high degree of reliability with no wear and low cost. Additionally, use of the safety and security device does not require firearm modification.

Functional aspects of the physical safety and security device are achieved by its outside profile while the body serves to maintain necessary spacial relationships. Accordingly, the safety and security device becomes multi-functional when the body is shaped to retain or hold corrosion control agents within the firearm. Similarly, the outer surface of the safety and security device can be shaped in such a way as to provide a dust and anti-tampering cover.

Further objects and advantages of my invention will become apparent from consideration of the drawings and the ensuing description of it.

DESCRIPTION OF PREFERRED EMBODIMENTS

Figure 4:
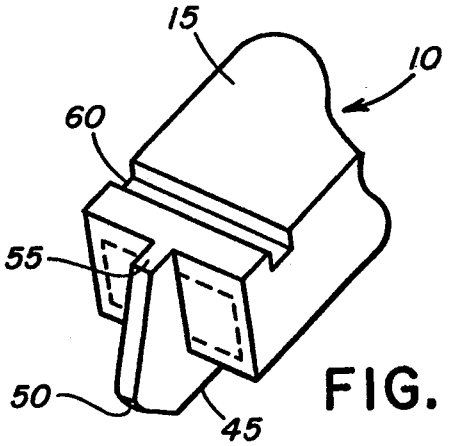
FIG. 4 is a fragmented perspective view, at enlarged scale, from upper left front, illustrating the invention with the body shaped as a container for anti-corrosion agents. The body has slits, apertures, or other means present to allow air exchange.
Figure 1:
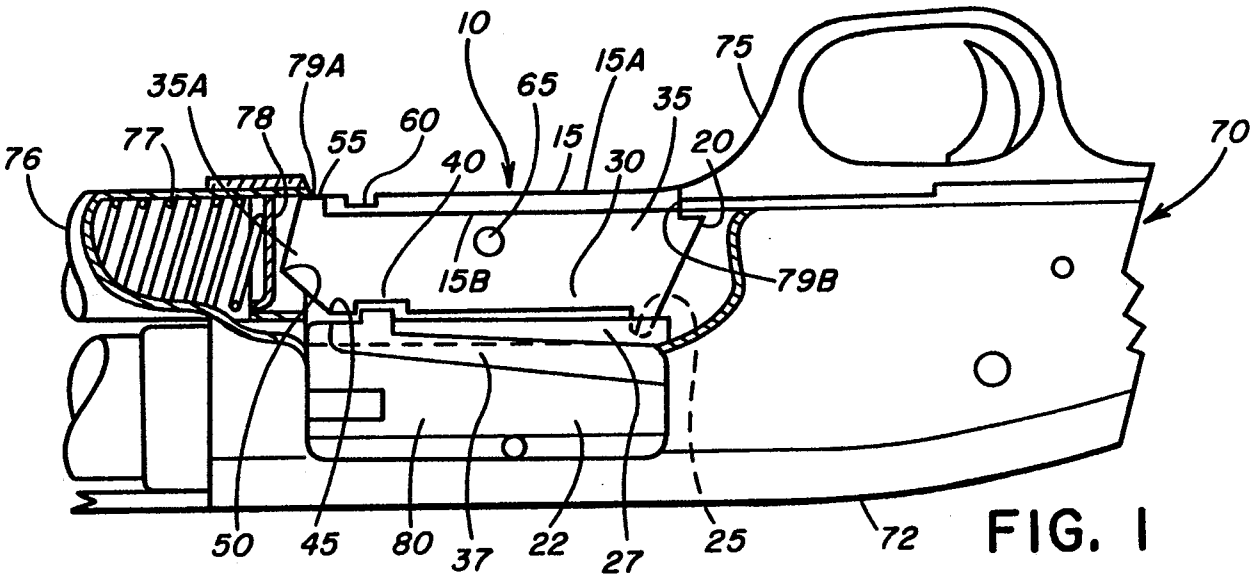
FIG. 1 is a cutaway side elevation view, at decresed scale, illustrating the invention in the operative position of a tubular magazine firearm.

Referring first to FIG. 1 of the drawings, subject invention 10 is a child resistant safety and security device illustrated in the operative position in loading port 79 of a tubular magazine 76 equipped firearm 70 such as a Mossberg 500 series shotgun. The firearm 70 is illustrated herein with the receiver 72 cutaway for clarity.

A tubular magazine 76 containing a magazine spring 77 and a magazine follower 78 is terminated with magazine follower 78 at the end of magazine tube 76 abutting loading port 79. Magazine spring 77 is under preload compression as retained by magazine follower 78.

The safety and security device 10 includes a flat dust and anti-tampering cover 15 having opposite outside and inside surfaces 15A, 15B and being of a length and width adequate to fit with and substantially close the loading port 79 of the hollow tubular magazine 76 of the firearm 70, and a body 35 attached to and projecting from the inside surface 15B of the cover 15 which faces toward the hollow tubular magazine 76. The body 35 is adapted to extend within the hollow tubular magazine 76 of the firearm 70 and substantially between a pair of opposite ends 79A, 79B of the loading port 79 thereof with the cover 15 fitted with and closing the loading port 79. The device 10 also includes a recess 60 defining a shoulder on the outside surface 15A of the cover 15 to allow engagement of an object, such as the finger tips of the user's hand, with the cover 15 to facilitate release and removal of the cover 15 from the loading port 79 of the hollow tubular magazine 76. The device 10 further includes securing means defined on opposite ends of the body 35 being adapted to engage the opposite ends of the loading port 79 of the hollow tubular magazine 76 and releasably mount the device 10 thereto so as to retain the body 35 within the loading port 79 in a position, as seen in FIG. 1, which blocks and prevents operation of the loading mechanism within the receiver 72 of the firearm 70. More particularly, the securing means includes a protruding nose 35A defined on one of the opposite ends of the body for extending beyond and engaging one opposite end 79A of the loading port 79 to compress the magazine spring 77, and a recessed catch 20 defined on the other of the opposite ends of the body 10 for releasably engaging the other opposite end 79B of the loading port 79. The engagement of the protruding nose 35A of the body 35 with the one loading port end and the magazine spring 77 and of the catch 20 with the other loading port end to retains the cover 15 fitted with the loading portion 79 and the body 35 within the hollow magazine 76 in such position that blocks and prevents operation of the loading mechanism of the firearm 70.

Figure 2:
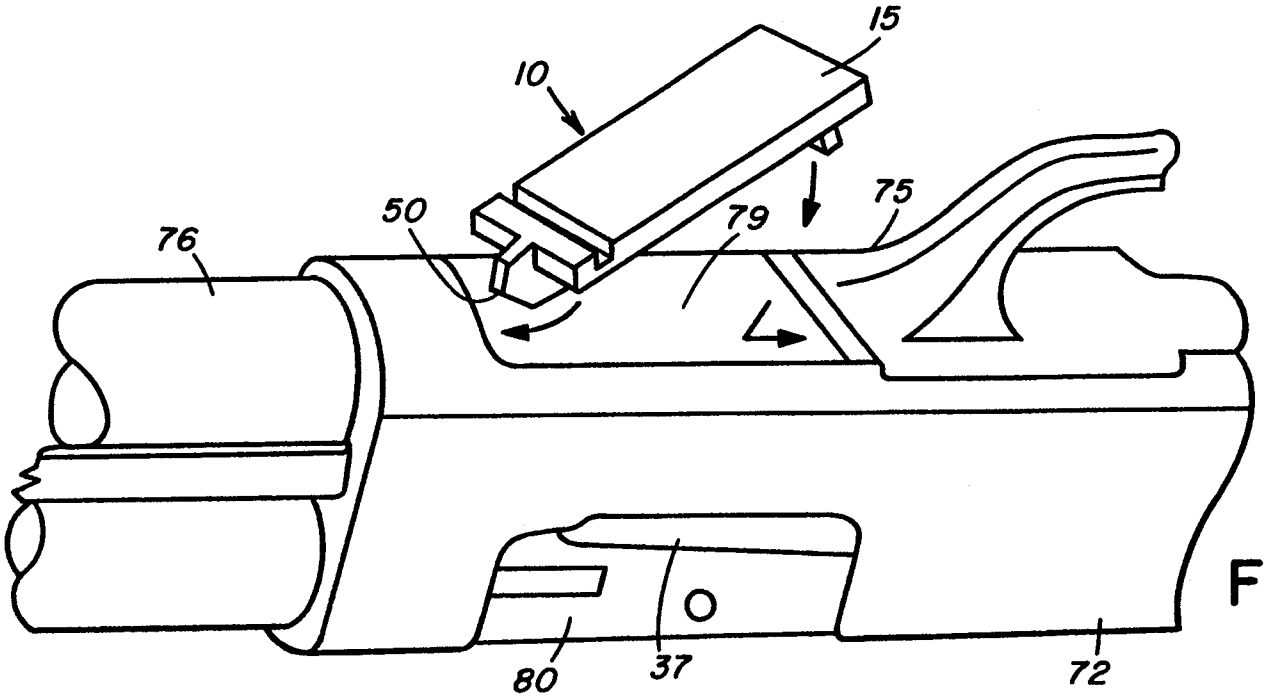
FIG. 2 is a perspective view, at decreased scale, from upper left front, illustrating subject invention in position to be inserted into the loading port of a tubular magazine firearm. Arrows illustrate the direction of movement.
Figure 6:
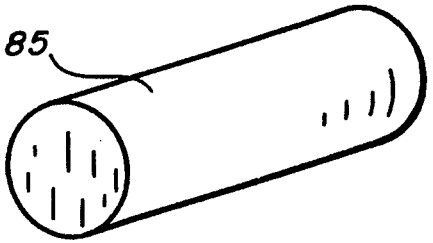
FIG. 6 is a perspective view, at reduced scale, from upper left front, illustrating a solid cylindrical spacer.

Installation of safety and security device 10, FIG. 2, requires only insertion, pivot point 50 forward, dust and anti-tapering cover 15 upward, through loading port 79 and into magazine tube 76 as though safety and security device 10 were a shell. Pivot point 50 abuts magazine follower 78 or spacers 85, FIG. 6, as insertion of the safety and security device 10 further compresses magazine spring 77. Upon insertion as far forward as possible safety and security device 10 is pushed downward into loading port 79 as far as possible. Allowing magazine spring 77 to move safety and security device 10 oppositely to the rear will enable catch 20 to forcibly engage under trigger guard housing 75. Engagement is maintained by means of pressure provided by compressed magazine spring 77. Accordingly, the force required for installation and removal of safety and security device 10 is determined by spacers 85, FIG. 6, if any, inserted through the loading port 79 into magazine tube 76 prior to insertion of safety and security device 10.

Figure 3:
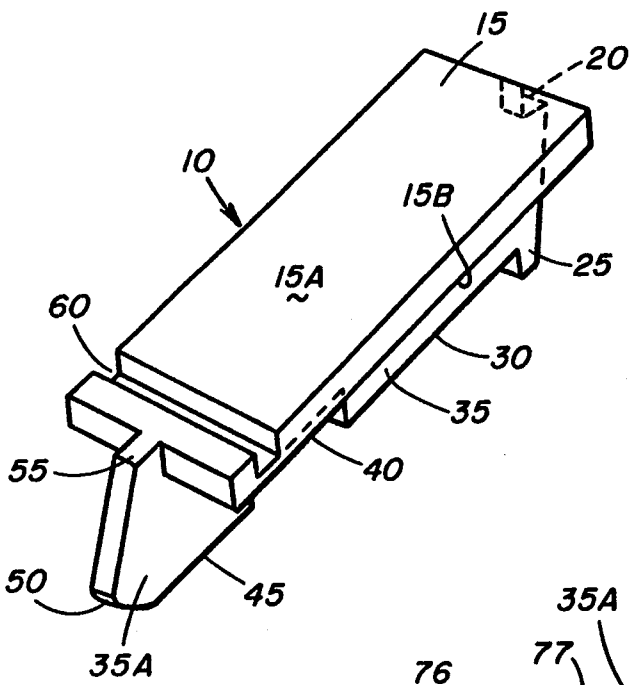
FIG. 3 is a perspective view, at enlarged scale, from upper left front, in which the present invention is shown.
Figure 5:
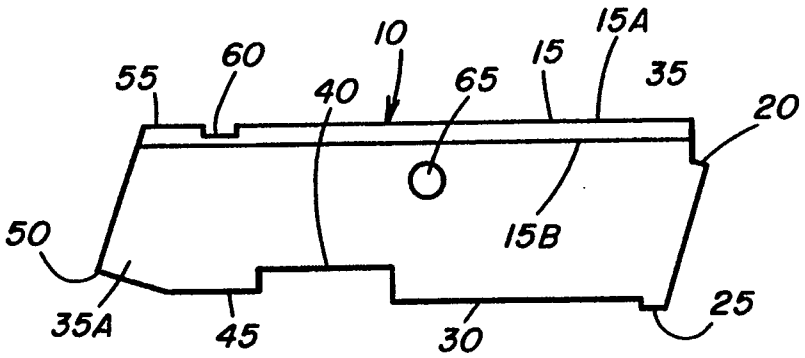
FIG. 5 is a left side, elevation view, at actual scale, illustrating an aperture for retention of anti-corrosion agents or containers of anti-corrosion agents. Contuor or profile of the safety and security device is dependent upon the firearm for which it is dedicated and is variable.

Safety and security device 10, FIG. 3, disables the firearm 70 by blocking and preventing operation of the loading mechanism made up of an elevator 37 and bolt slide 27 and thereby disrupting the loading and firing cycle. Accordingly, firearm 70 cannot be loaded externally, through ejection port 80 or internally from magazine 76.

While in operative position, safety and security device 10, FIG. 1, acts not only to prevent loading firearm 70, but also provides a dust and anti-tampering cover 15 as well as a container in which anti-corrosion agents may be retained within the interior of firearm 70. Use of adhesives, apertures 65, or other methods to attach anti-corrosion agents to the safety and security device 10 allows such anti-corrosion agents to be held in place yet instantly removable with the safety and security device 10.

Removal requires only that dust and anti-tapering cover 15 be forcibly engaged, at the recess 60 defining the shoulder on the outside surface 15A of the cover 15, and safety and security device 10 be moved forward against magazine spring 77 pressure. Such movement disengages catch 20. Safety and security device 10 flips clear of firearm 70 and firearm 70 is instantly operable.

The terms and expressions employed in the foregoing specification are used as terms of description, not limitation, and there is no intention of excluding equivalents of the features shown and described. Various changes and alterations might be made without departing from the spirit and broader aspects of the invention as set forth in the claims.

REFERENCE NUMBERS IN DRAWINGS

| | |
|---|---|
| 10 safety and security device | 55 retainer |
| 15 dust and anti-tampering cover | 60 recess |
| 20 catch | 65 holding aperture |
| 22 bolt | 70 firearm |
| 25 bolt block | 72 receiver |
| 27 bolt slide | 75 trigger guard housing |
| 30 centering key | 76 magazine tube |
| 35 body | 77 magazine spring |
| 37 elevator | 78 magazine follower |
| 40 elevator notch | 79 loading port |
| 45 elevator block | 80 ejection port |
| 50 pivot point | 85 spacer |

I claim:

1. In combination with a firearm including a receiver, a hollow tubular magazine having a loading port of predetermined length and width with a pair of spaced opposite ends, a loading mechanism within the receiver, and a compressible spring disposed in said tubular magazine adjacent to one of said pair of spaced opposite ends of said loading port, a child resistant safety and security device comprising:

(a) a cover having opposite outside and inside surfaces and being of a length and width adequate to fit with and close the loading port of the hollow tubular magazine of the firearm;

(b) a body attached to and projecting from said inside surface of said cover which faces toward the hollow tubular magazine, said body being adapted to extend within the hollow tubular magazine of the firearm and substantially between said pair of spaced opposite ends of the loading port thereof with said cover substantially fitting and closing the loading port thereof; and (c) securing means defined on opposite ends of at least one of said body and cover for engaging said spaced opposite ends of the loading port of the hollow tubular magazine and releasably mounting said device thereto so as to retain said body within the loading port in a position which prevents operation of the loading mechanism within the receiver of the firearm;

(d) said securing means including a protruding nose fixedly defined on one of said opposite ends of said body for extending within said hollow magazine beyond said one of said opposite ends of the loading port of the hollow tubular magazine to engage and compress said compressible spring disposed in said hollow tubular magazine adjacent to said one end of said loading port, said securing means also including a recessed catch fixedly defined on the other of said opposite ends of said rigid body and cover and adapted to engage the other of said spaced opposite ends of said loading port of said hollow tubular magazine, said spring being adapted to produce a biasing force against said protruding nose of said body so as to cause said recessed catch to forceably engage said other of said spaced opposite ends of said loading port and thereby retain said body within said hollow magazine and thereby prevent operation of said loading mechanism within said receiver, said compressible spring being yieldable upon forceable movement of said body and cover toward said spring overcoming said biasing force so as to permit said recessed catch to disengage from said other of said spaced opposite ends of said loading port and facilitate release and removal of said cover and body from said hollow magazine and thereby permit operation of said loading mechanism within said receiver.

2. The safety and security device of claim 1 further comprising:

means defining a shoulder on said outside surface of said cover adapted to allow engagement of an object with said cover so as to facilitate release and removal of said cover from the loading port of the hollow tubular magazine of the firearm.

3. The safety and security device of claim 2 wherein said shoulder is recessed in said outside surface of said cover to allow forcible engagement of the object with said device to facilitate release and removal thereof from the firearm.

4. The safety and security device of claim 1 wherein said body includes means for retaining an anti-corrosion agent within the receiver of the firearm.

5. A child resistant safety and security device for a firearm utilizing a receiver, a hollow tubular magazine including a loading port of predetermined length and width, a loading mechanism within the receiver, and a compressible spring within the hollow tubular magazine, said device comprising:

(a) a cover having opposite outside and inside surfaces and being of a length and width adequate to fit with and close the loading port of the hollow tubular magazine of the firearm;

(b) means defining a shoulder on said outside surface of said cover to allow engagement of an object with said cover so as to facilitate release and removal of said cover from the loading port of the hollow tubular magazine of the firearm;

(c) a body attached to and projecting from said inside surface of said cover which faces toward the hollow tubular magazine, said body being adapted to extend within the hollow tubular magazine of the firearm and substantially between a pair of opposite ends of the loading port thereof with said cover fitting and closing the loading port thereof, said body including means for retaining an anti-corrosion agent within the receiver of the firearm; and (d) securing means defined on opposite ends of at least one of said body and cover for engaging the opposite ends of the loading port of the hollow tubular magazine and releasably mounting said device thereto so as to retain said body within the loading port in a position which prevents operation of the loading mechanism within the receiver of the firearm, said securing means includes a protruding nose defined on one of said opposite ends of said body for extending beyond one of the opposite ends of the loading port of the hollow tubular magazine to compress the spring disposed in the hollow tubular magazine, and a recessed catch defined on the other of said opposite ends of said body and cover for releasably engaging the other of the opposite ends of the loading port of the hollow tubular magazine to retain said body within the loading port in said position which prevents operation of the loading mechanism of the firearm.

6. The safety and security device of claim 5 wherein said shoulder is recessed in said outside surface of said cover to allow forcible engagement of the object with said device to facilitate release and removal thereof from the firearm.

7. The safety and security device of claim 5 wherein said means for retaining said anti-corrosion agent is a container formed by said body.

8. A method of making safe a firearm having a receiver, a hollow tubular magazine having a loading port, and a loading mechanism in the receiver, said method comprising the steps of:

(a) providing a child resistant safety and security device including a cover having a pair of opposite ends and a pair of opposite outside and inside surfaces and being of a length and width adequate to fit with and close the loading port of the hollow tubular magazine of the firearm, and a body attached to and projecting from the inside surface of the cover and having a pair of opposite ends;

(b) inserting the body of the child resistant safety and security device into the loading port such that said body extends between a pair of opposite ends of the loading pore and prevents operation of the loading mechanism of the firearm;

(c) fitting said cover of the child resistant safety and security device to the loading port of the magazine such that the cover substantially closes the loading port;

(d) engaging and releasably securing the cover at said pair of opposite ends thereof with the pair of opposite ends of the loading port of the hollow tubular magazine by (i) extending a protruding nose defined on one of the pair of opposite ends of said body and cover within the magazine beyond one of the opposite ends of the loading port of the hollow tubular magazine so as to forceably engage and compress a compressible spring disposed in the hollow tubular magazine, and (ii) engaging a recessed catch defined on the other of the pair of opposite ends of the body and cover with the other of the opposite ends of the loading port of the hollow tubular magazine, the forceable engagement and compression of the spring by the protruding nose of the body producing a biasing force against the protruding nose which causes the recessed catch to forceably engage the other of the opposite ends of the loading port and thereby retain the body within the hollow magazine and thereby prevent operation of the loading mechanism within said receiver, the device being releasable only by applying sufficient force to move the body and cover against the spring and overcome the biasing force thereof so as to permit the recessed catch on the body to disengage from the other of the opposite ends of the loading port and facilitate release and removal of the cover and body from the hollow magazine and thereby permit operation of the loading mechanism within the receiver.

9. The method of claim 8 further comprising:

providing and retaining an anti-corrosion agent within the receiver of the firearm.

10. A child resistant safety and security device for a firearm utilizing a receiver, a hollow tubular magazine having a loading port of predetermined length and width and, a loading mechanism within the receiver, said device comprising:

(a) a cover having opposite outside and inside surfaces and being of a length and width adequate to fit with and close the loading port of the hollow tubular magazine of the firearm;

(b) a body attached to and projecting from said inside surface of said cover which faces toward the hollow tubular magazine, said body being adapted to extend within the hollow tubular magazine of the firearm and substantially between a pair of opposite ends of the loading port thereof with said cover substantially fitting and closing the loading port thereof, said body including means for retaining an anti-corrosion agent within the receiver of the firearm; and (c) securing means defined on opposite ends of at least one of said body and cover for engaging the opposite ends of the loading port of the hollow tubular magazine and releasably mounting said device thereto so as to retain said body within the loading port in a position which prevents operation of the loading mechanism within the receiver of the firearm.

11. The safety and security device of claim 10 wherein said retaining means is a container formed by said body to retain the anti-corrosion agent.

12. The safety and security device of claim 10 wherein:

the hollow tubular magazine of the firearm includes a compressible spring; and said securing means includes a protruding nose defined on one of said opposite ends of said body for extending beyond one of the opposite ends of the loading port of the hollow tubular magazine to compress the spring disposed in the hollow tubular magazine, and a recessed catch defined on the other of said opposite ends of said rigid body and cover for releasably engaging the other of the opposite ends of the loading port of the hollow tubular magazine to retain said body within the hollow magazine in said position which prevents operation of the loading mechanism within the receiver.

13. A method of making safe a firearm having a receiver a hollow tubular magazine having a loading port, and a loading mechanism in the receiver, said method comprising the steps of:

(a) providing a child resistant safety and security device including a cover having opposite outside and inside surfaces and being of a length and width adequate to fit with and close the loading port of the hollow tubular magazine of the firearm, and a body attached to and projecting from the inside surface of the cover;

(b) inserting the body of the child resistant safety and security device into the loading port such that said body extends between a pair of opposite ends of the loading port and prevents operation of the loading mechanism of the firearm;

(c) fitting the cover of the child resistant safety and security device to the loading port of the magazine such that the cover substantially closes the loading port; and (d) providing and retaining an anti-corrosion agent within the receiver of the firearm.

14. The method of claim 13 further comprising:

engaging and releasably securing the cover at a pair of opposite ends thereof to the pair of opposite ends of the loading port of the hollow tubular magazine.

15. The method of claim 14 wherein said engaging and securing the cover includes extending a protruding nose defined on one of the pair of opposite ends of said rigid body beyond one of the opposite ends of the loading port of the hollow tubular magazine to compress a compressible spring disposed in the hollow tubular magazine.

16. The method of claim 15 wherein said engaging and securing the cover includes engaging a recessed catch defined on the other of the pair of opposite ends of the body and cover with the other of the opposite ends of the loading port of the hollow tubular magazine to retain the body within the loading port and prevent operation of the loading mechanism in the receiver of the firearm.

* * * * *